US011987339B1

(12) United States Patent
Ikegaya

(10) Patent No.: US 11,987,339 B1
(45) Date of Patent: May 21, 2024

(54) STEERING CONTROL SYSTEM OF MARINE VESSEL, MARINE VESSEL AND STEERING CONTROL METHOD OF MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 735 days.

(21) Appl. No.: 17/120,520

(22) Filed: Dec. 14, 2020

Related U.S. Application Data

(60) Provisional application No. 62/953,714, filed on Dec. 26, 2019.

(51) Int. Cl.
*B63H 25/04* (2006.01)
*B63H 25/42* (2006.01)
*B63H 25/02* (2006.01)

(52) U.S. Cl.
CPC ..... *B63H 25/04* (2013.01); *B63H 25/42* (2013.01); *B63H 2025/022* (2013.01); *B63H 2025/026* (2013.01)

(58) Field of Classification Search
CPC .. B63H 25/04; B63H 25/42; B63H 2025/022; B63H 2025/026
See application file for complete search history.

(56) References Cited

U.S. PATENT DOCUMENTS

| | | | | |
|---|---|---|---|---|
| 2011/0166724 | A1 | 7/2011 | Hiramatsu | |
| 2016/0318592 | A1* | 11/2016 | Mizutani | B63H 25/52 |
| 2016/0349767 | A1* | 12/2016 | Ito | B63H 20/00 |
| 2020/0407030 | A1* | 12/2020 | Ueno | B63B 79/10 |

FOREIGN PATENT DOCUMENTS

| | | | |
|---|---|---|---|
| JP | 62-017900 | A | 1/1987 |
| JP | 3493345 | B2 | 2/2004 |
| JP | 5337722 | B2 | 11/2013 |
| JP | 6263087 | B2 | 1/2018 |

* cited by examiner

*Primary Examiner* — Rodney A Butler
(74) *Attorney, Agent, or Firm* — Keating & Bennett, LLP

(57) ABSTRACT

A steering control system of a marine vessel includes a controller configured or programmed to perform at least one of a control to automatically steer the marine vessel or a control to automatically change a propulsive force of a propulsion device in an automatic marine vessel maneuvering mode during movement of the marine vessel, and an operator for the marine vessel to perform a predetermined operation. The controller is configured or programmed to cancel the automatic marine vessel maneuvering mode based on an operation performed on the operator by a vessel operator to perform the predetermined operation during the movement of the marine vessel in the automatic marine vessel maneuvering mode.

20 Claims, 6 Drawing Sheets

STEERING CONTROL SYSTEM OF MARINE VESSEL, MARINE VESSEL AND STEERING CONTROL METHOD OF MARINE VESSEL

CROSS REFERENCE TO RELATED APPLICATIONS

This application claims the benefit of priority to U.S. Provisional Application No. 62/953,714 filed on Dec. 26, 2019. The entire contents of this application are hereby incorporated herein by reference.

BACKGROUND OF THE INVENTION

1. Field of the Invention

The present invention relates to a steering control system of a marine vessel, a marine vessel, and a steering control method of a marine vessel.

2. Description of the Related Art

A steering control system of a marine vessel, a marine vessel, and a steering control method of a marine vessel are known in general. Such a steering control system is disclosed in Japanese Patent Laid-Open No. 62-017900, for example.

Japanese Patent Laid-Open No. 62-017900 discloses a collision prevention device (a steering control system of a marine vessel) that performs a control using an autopilot device. The collision prevention device includes a planned course generator, a steering angle speed converter, and an engine controller. The planned course generator outputs a signal to the autopilot device via the steering angle speed converter such that a marine vessel navigates along a planned course. Furthermore, the collision prevention device includes a danger condition determination circuit and an avoidance course calculation circuit. The danger condition determination circuit detects another marine vessel. The avoidance course calculation circuit calculates a course to avoid another marine vessel when another marine vessel is detected by the danger condition determination circuit. The autopilot device and the engine controller automatically control the marine vessel such that the marine vessel navigates along the planned course when another marine vessel is not detected. In addition, the autopilot device and the engine controller automatically control the marine vessel such that the marine vessel navigates along the course to avoid another marine vessel instead of the planned course when another marine vessel is detected.

Although not described in Japanese Patent Laid-Open No. 62-017900, a vessel operator (user) may wish to cancel an automatic marine vessel maneuvering mode by his or her own operation when the marine vessel is navigating along the planned course or the course to avoid another marine vessel using the autopilot device and the engine controller (when the marine vessel is moving in the automatic marine vessel maneuvering mode). Therefore, the autopilot device conceivably includes a dedicated operator to cancel the automatic marine vessel maneuvering mode. However, when the autopilot device (the steering control system of a marine vessel) newly includes a dedicated operator to cancel the automatic marine vessel maneuvering mode, the structure of the steering control system of the marine vessel conceivably becomes complex. Therefore, conventionally, a steering control system of a marine vessel, a marine vessel, and a steering control method of a marine vessel that each allow a vessel operator to cancel an automatic marine vessel maneuvering mode by his or her operation while a complex structure of the steering control system of the marine vessel is significantly reduced or prevented have been desired.

SUMMARY OF THE INVENTION

Preferred embodiments of the present invention provide steering control systems of marine vessels, marine vessels, and steering control methods of marine vessels that each allow a vessel operator to cancel an automatic marine vessel maneuvering mode by his or her operation while complex structures of the steering control systems of the marine vessels are significantly reduced or prevented.

According to a first preferred embodiment of the present invention, a steering control system of a marine vessel includes a controller configured or programmed to perform at least one of a control to automatically steer the marine vessel or a control to automatically change a propulsive force of a propulsion device in an automatic marine vessel maneuvering mode during movement of the marine vessel, and an operator to perform at least one predetermined operation of operating the propulsion device, starting the automatic marine vessel maneuvering mode by the controller, or turning on/off power supply to the propulsion device. The controller is configured or programmed to cancel the automatic marine vessel maneuvering mode based on an operation performed on the operator by a vessel operator to perform the predetermined operation during the movement of the marine vessel in the automatic marine vessel maneuvering mode.

In the steering control system of the marine vessel described above, the controller is configured or programmed to cancel the automatic marine vessel maneuvering mode based on the operation performed on the operator by the vessel operator to perform the predetermined operation during the movement of the marine vessel in the automatic marine vessel maneuvering mode. Accordingly, the automatic marine vessel maneuvering mode is canceled based on the operation performed on the existing operator of the steering control system of the marine vessel by the vessel operator without newly providing a dedicated operator to cancel the automatic marine vessel maneuvering mode in the steering control system of the marine vessel. Consequently, the automatic marine vessel maneuvering mode is canceled based on the operation performed by the vessel operator while a complex structure of the steering control system of the marine vessel is significantly reduced or prevented.

In the steering control system of the marine vessel described above, the operator preferably includes a steering operator to steer the marine vessel and an operation lever to manipulate the propulsive force of the propulsion device, and the controller is preferably configured or programmed to cancel the automatic marine vessel maneuvering mode based on at least one of an operation performed on the steering operator by the vessel operator to steer the marine vessel or an operation performed on the operation lever by the vessel operator to manipulate the propulsive force of the propulsion device during the movement of the marine vessel in the automatic marine vessel maneuvering mode. Accordingly, when the marine vessel is moving in the automatic marine vessel maneuvering mode, the vessel operator easily cancels the automatic marine vessel maneuvering mode by operating at least one of the steering operator or the operation lever. When a manual control is performed by at least one of the steering operator or the operation lever after the automatic marine vessel maneuvering mode is canceled, the manual operation (control) is quickly started by at least one of the steering operator or the operation lever used to cancel the automatic marine vessel maneuvering mode after the automatic marine vessel maneuvering mode is canceled.

In such a case, the operation lever is preferably movable to any of a forward movement position, a neutral position, and a reverse movement position, and the controller is preferably configured or programmed to cancel the automatic marine vessel maneuvering mode based on the operation lever being moved from the forward movement position to either the neutral position or the reverse movement position by the vessel operator during the movement of the marine vessel in the automatic marine vessel maneuvering mode. Accordingly, when the vessel operator intends to cancel the automatic marine vessel maneuvering mode, the vessel operator easily cancels the automatic marine vessel maneuvering mode by moving the operation lever from the forward movement position to either the neutral position or the reverse movement position. When a manual control is performed by the operation lever after the automatic marine vessel maneuvering mode is canceled, the manual operation (control) is quickly started by the operation lever used to cancel the automatic marine vessel maneuvering mode after the automatic marine vessel maneuvering mode is canceled.

In the steering control system of the marine vessel including the operation lever being movable to any of the forward movement position, the neutral position, and the reverse movement position, the operator preferably includes a plurality of operation levers, and the controller is preferably configured or programmed to cancel the automatic marine vessel maneuvering mode based on all of the plurality of operation levers being moved to neutral positions during the movement of the marine vessel in the automatic marine vessel maneuvering mode. Accordingly, even when the plurality of operation levers are provided in the steering control system of the marine vessel, the vessel operator easily cancels the automatic marine vessel maneuvering mode by moving all of the plurality of operation levers to the neutral positions.

In the steering control system of the marine vessel including the operation lever being movable to any of the forward movement position, the neutral position, and the reverse movement position, the operator preferably includes a plurality of operation levers, and the controller is preferably configured or programmed to cancel the automatic marine vessel maneuvering mode based on at least one of the plurality of operation levers being moved to the reverse movement position during the movement of the marine vessel in the automatic marine vessel maneuvering mode. Accordingly, even when the plurality of operation levers are provided in the steering control system of the marine vessel, the vessel operator more easily cancels the automatic marine vessel maneuvering mode by moving at least one of the plurality of operation levers to the reverse movement position.

In the steering control system of the marine vessel including the steering operator and the operation lever, the steering operator preferably includes a steering wheel, and the controller is preferably configured or programmed to cancel the automatic marine vessel maneuvering mode based on the steering wheel being rotated by the vessel operator during the movement of the marine vessel in the automatic marine vessel maneuvering mode. Accordingly, the steering wheel is rotated such that the automatic marine vessel maneuvering mode is easily canceled. When a manual control is performed by the steering wheel after the automatic marine vessel maneuvering mode is canceled, the manual operation (control) is quickly started by the steering wheel used to cancel the automatic marine vessel maneuvering mode after the automatic marine vessel maneuvering mode is canceled.

In the steering control system of the marine vessel described above, the operator preferably includes an automatic marine vessel maneuvering mode operator to start the automatic marine vessel maneuvering mode, and the controller is preferably configured or programmed to cancel the automatic marine vessel maneuvering mode based on an operation performed on the automatic marine vessel maneuvering mode operator by the vessel operator during the movement of the marine vessel in the automatic marine vessel maneuvering mode. Accordingly, when the vessel operator intends to cancel the automatic marine vessel maneuvering mode, the vessel operator easily cancels the automatic marine vessel maneuvering mode by operating the automatic marine vessel maneuvering mode operator.

In the steering control system of the marine vessel described above, the operator preferably includes a power switch to turn on/off power supply from a power source to the propulsion device, and the controller is preferably configured or programmed to cancel the automatic marine vessel maneuvering mode based on an operation performed on the power switch by the vessel operator during the movement of the marine vessel in the automatic marine vessel maneuvering mode. Accordingly, when the vessel operator intends to cancel the automatic marine vessel maneuvering mode, the vessel operator easily cancels the automatic marine vessel maneuvering mode by operating the power switch.

The steering control system of the marine vessel described above preferably further includes an orientation sensor to detect an orientation of a hull, and a position sensor to detect a position of the hull, and the controller is preferably configured or programmed to detect an abnormality in at least one of the orientation sensor or the position sensor, and cancel the automatic marine vessel maneuvering mode based on the abnormality detected in at least one of the orientation sensor or the position sensor during the movement of the marine vessel in the automatic marine vessel maneuvering mode. Accordingly, when an abnormality occurs in the orientation sensor or the position sensor during the movement of the marine vessel in the automatic marine vessel maneuvering mode, continuation of the automatic marine vessel maneuvering mode is significantly reduced or prevented.

In the steering control system of the marine vessel described above, the operator preferably includes an automatic marine vessel maneuvering mode operator to start the automatic marine vessel maneuvering mode and an operation lever to manipulate the propulsive force of the propulsion device, the operation lever is preferably movable to any of a forward movement position, a neutral position, and a reverse movement position, the controller is preferably configured or programmed to cancel the automatic marine vessel maneuvering mode based on the operation lever being moved from the forward movement position to either the neutral position or the reverse movement position by the vessel operator during the movement of the marine vessel in the automatic marine vessel maneuvering mode, and to start a manual marine vessel maneuvering mode to change the propulsive force of the propulsion device by a manual operation on the operation lever, and the controller is preferably configured or programmed to cancel the manual marine vessel maneuvering mode based on the operation lever being moved from either the neutral position or the reverse movement position to the forward movement position by the vessel operator during movement of the marine vessel in the manual marine vessel maneuvering mode and the automatic marine vessel maneuvering mode operator being operated by the vessel operator during the movement of the marine vessel in the manual marine vessel maneuvering mode, and to restart the automatic marine vessel maneuvering mode. Accordingly, when the vessel operator intends to start the manual marine vessel maneuvering mode using the operation lever, the vessel operator easily starts the manual marine vessel maneuvering mode by moving the operation lever from the forward movement position to either the neutral position or the reverse movement position. In a preferred embodiment of the present invention, the automatic marine vessel maneuvering mode is restarted based on the operation lever being moved to the forward movement position by the vessel operator and the automatic marine vessel maneuvering mode operator performed by the vessel operator. Thus, the automatic marine vessel maneuvering mode is not restarted when the vessel operator moves the operation lever to the forward movement position without intending to restart the automatic marine vessel maneuvering mode. Therefore, restart of the automatic marine vessel maneuvering mode contrary to the intention of the vessel operator is significantly reduced or prevented.

In the steering control system of the marine vessel described above, the controller is preferably configured or programmed to perform any of a control to move a hull while maintaining an orientation of the hull, a control to move the hull while maintaining a course of the hull, a control to move the hull such that the hull passes through a target passing point, and a control to move the hull along a predetermined course pattern in the automatic marine vessel maneuvering mode. Accordingly, when any of the control to move the hull while maintaining the orientation of the hull, the control to move the hull while maintaining the course of the hull, the control to move the hull such that the hull passes through the target passing point, and the control to move the hull along the predetermined course pattern is performed during the movement of the marine vessel, the automatic marine vessel maneuvering mode is easily canceled according to the intention of the vessel operator.

A marine vessel according to a second preferred embodiment of the present invention includes a hull, a propulsion device attached to the hull, a controller configured or programmed to perform at least one of a control to automatically steer the hull or a control to automatically change a propulsive force of the propulsion device in an automatic marine vessel maneuvering mode during movement of the marine vessel, and an operator to perform at least one predetermined operation of operating the propulsion device, starting the automatic marine vessel maneuvering mode by the controller, or turning on/off power supply to the propulsion device. The controller is configured or programmed to cancel the automatic marine vessel maneuvering mode based on an operation performed on the operator by a vessel operator to perform the predetermined operation during the movement of the marine vessel in the automatic marine vessel maneuvering mode.

In the marine vessel with the structure described above, the automatic marine vessel maneuvering mode is canceled based on the operation performed by the vessel operator while a complex structure of a steering control system of the marine vessel is significantly reduced or prevented, similarly to the steering control system of the marine vessel according to the first preferred embodiment of the present invention.

In the marine vessel described above, the operator preferably includes a steering operator to steer the marine vessel and an operation lever to manipulate the propulsive force of the propulsion device, and the controller is preferably configured or programmed to cancel the automatic marine vessel maneuvering mode based on at least one of an operation performed on the steering operator by the vessel operator to steer the marine vessel or an operation performed on the operation lever by the vessel operator to manipulate the propulsive force of the propulsion device during the movement of the marine vessel in the automatic marine vessel maneuvering mode. Accordingly, when the marine vessel is moving in the automatic marine vessel maneuvering mode, the vessel operator easily cancels the automatic marine vessel maneuvering mode by operating at least one of the steering operator or the operation lever. When a manual control is performed by at least one of the steering operator or the operation lever after the automatic marine vessel maneuvering mode is canceled, the manual operation (control) is quickly started by at least one of the steering operator or the operation lever used to cancel the automatic marine vessel maneuvering mode after the automatic marine vessel maneuvering mode is canceled.

In such a case, the operation lever is preferably movable to any of a forward movement position, a neutral position, and a reverse movement position, and the controller is preferably configured or programmed to cancel the automatic marine vessel maneuvering mode based on the operation lever being moved from the forward movement position to either the neutral position or the reverse movement position by the vessel operator during the movement of the marine vessel in the automatic marine vessel maneuvering mode. Accordingly, when the vessel operator intends to cancel the automatic marine vessel maneuvering mode, the vessel operator easily cancels the automatic marine vessel maneuvering mode by moving the operation lever from the forward movement position to either the neutral position or the reverse movement position. When a manual control is performed by the operation lever after the automatic marine vessel maneuvering mode is canceled, the manual operation (control) is quickly started by the operation lever used to cancel the automatic marine vessel maneuvering mode after the automatic marine vessel maneuvering mode is canceled.

A steering control method of a marine vessel according to a third preferred embodiment of the present invention includes performing at least one of a control to automatically steer the marine vessel or a control to automatically change a propulsive force of a propulsion device in an automatic marine vessel maneuvering mode during movement of the marine vessel, and canceling the automatic marine vessel maneuvering mode based on an operation performed on an operator by a vessel operator to perform at least one predetermined operation of operating the propulsion device, starting the automatic marine vessel maneuvering mode, or turning on/off power supply to the propulsion device during the movement of the marine vessel in the automatic marine vessel maneuvering mode.

In the steering control method of the marine vessel described above, the automatic marine vessel maneuvering mode is canceled based on the operation performed by the vessel operator while a complex structure of a steering control system of the marine vessel is significantly reduced or prevented, similarly to the steering control system of the marine vessel according to the first preferred embodiment of the present invention.

In the steering control method of the marine vessel described above, the operator preferably includes a steering operator to steer the marine vessel and an operation lever to manipulate the propulsive force of the propulsion device, and the canceling of the automatic marine vessel maneuvering mode preferably includes canceling the automatic marine vessel maneuvering mode based on at least one of an operation performed on the steering operator by the vessel operator to steer the marine vessel or an operation performed on the operation lever by the vessel operator to manipulate the propulsive force of the propulsion device during the movement of the marine vessel in the automatic marine vessel maneuvering mode. Accordingly, when the marine vessel is moving in the automatic marine vessel maneuvering mode, the vessel operator easily cancels the automatic marine vessel maneuvering mode by operating at least one of the steering operator or the operation lever. When a manual control is performed by at least one of the steering operator or the operation lever after the automatic marine vessel maneuvering mode is canceled, the manual operation (control) is quickly started by at least one of the steering operator or the operation lever used to cancel the automatic marine vessel maneuvering mode after the automatic marine vessel maneuvering mode is canceled.

In such a case, the canceling of the automatic marine vessel maneuvering mode preferably includes canceling the automatic marine vessel maneuvering mode based on the operation lever being moved from a forward movement position to a neutral position or a reverse movement position by the vessel operator during the movement of the marine vessel in the automatic marine vessel maneuvering mode. Accordingly, when the vessel operator intends to cancel the automatic marine vessel maneuvering mode, the vessel operator easily cancels the automatic marine vessel maneuvering mode by moving the operation lever from the forward movement position to either the neutral position or the reverse movement position. When a manual control is performed by the operation lever after the automatic marine vessel maneuvering mode is canceled, the manual operation (control) is quickly started by the operation lever used to cancel the automatic marine vessel maneuvering mode after the automatic marine vessel maneuvering mode is canceled.

In the steering control method of the marine vessel including the canceling the automatic marine vessel maneuvering mode based on the operation lever being moved from the forward movement position to the neutral position, the operator preferably includes a plurality of operation levers, and the canceling of the automatic marine vessel maneuvering mode preferably includes canceling the automatic marine vessel maneuvering mode based on all of the plurality of operation levers being moved to neutral positions during the movement of the marine vessel in the automatic marine vessel maneuvering mode. Accordingly, even when the plurality of operation levers are provided in the steering control system of the marine vessel, the vessel operator easily cancels the automatic marine vessel maneuvering mode by moving all of the plurality of operation levers to the neutral positions.

In the steering control method of the marine vessel described above, the steering operator preferably includes a steering wheel, and the canceling of the automatic marine vessel maneuvering mode preferably includes canceling the automatic marine vessel maneuvering mode based on the steering wheel being rotated by the vessel operator during the movement of the marine vessel in the automatic marine vessel maneuvering mode. Accordingly, the steering wheel is rotated such that the automatic marine vessel maneuvering mode is easily canceled. When a manual control is performed by the steering wheel after the automatic marine vessel maneuvering mode is canceled, the manual operation (control) is quickly started by the steering wheel used to cancel the automatic marine vessel maneuvering mode after the automatic marine vessel maneuvering mode is canceled.

The steering control method of the marine vessel described above preferably further includes detecting an abnormality in at least one of an orientation sensor that detects an orientation of a hull or a position sensor that detects a position of the hull, and the canceling of the automatic marine vessel maneuvering mode preferably includes canceling the automatic marine vessel maneuvering mode based on the abnormality detected in at least one of the orientation sensor or the position sensor during the movement of the marine vessel in the automatic marine vessel maneuvering mode. Accordingly, when an abnormality occurs in the orientation sensor or the position sensor during the movement of the marine vessel in the automatic marine vessel maneuvering mode, continuation of the automatic marine vessel maneuvering mode is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 according to preferred embodiments of the present invention is now described with reference to FIGS. 1 to 9. In the figures, arrow FWD represents the forward movement direction of the marine vessel 100, and arrow BWD represents the reverse movement direction of the marine vessel 100.

Figure 1:
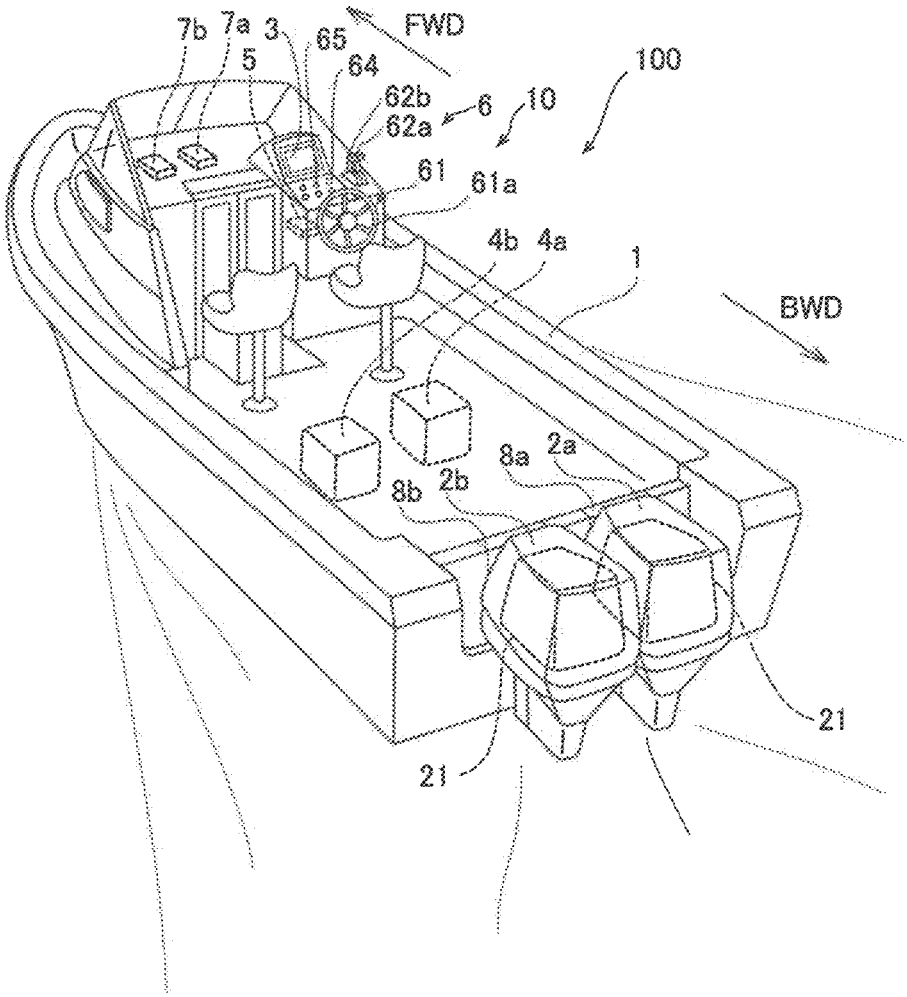
FIG. 1 is a perspective view schematically showing a marine vessel including outboard motors according to a preferred embodiment of the present invention.

As shown in FIG. 1, the marine vessel 100 includes a hull 1, outboard motors 2*a* and 2*b* attached to the hull 1, and a steering control system 10. That is, the marine vessel 100 is an outboard motor boat including the outboard motors 2*a* and 2*b*. Furthermore, the marine vessel 100 includes a navigation information display 3, a main battery 4*a*, and a steering battery 4*b*. The outboard motors 2*a* and 2*b* are attached to the rear of the hull 1. The outboard motors 2*a* and 2*b* are examples of a "propulsion device". The main battery 4*a* is an example of a "power source".

Figure 2:
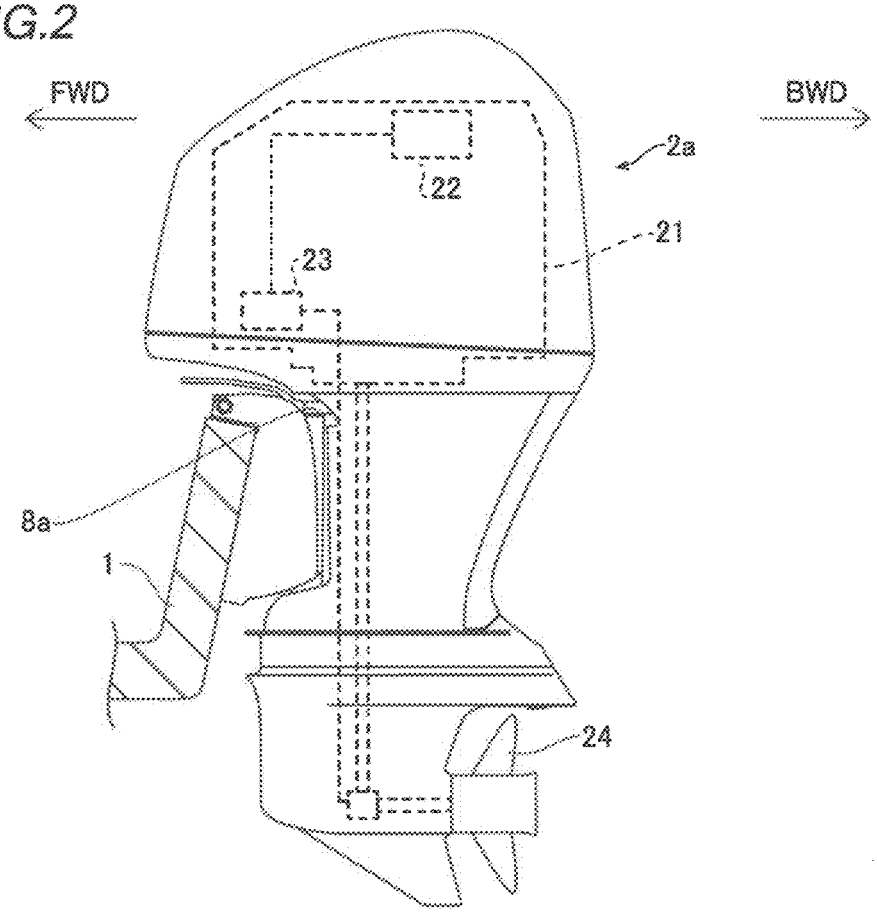
FIG. 2 is a side view illustrating the structure of an outboard motor according to a preferred embodiment of the present invention.

As shown in FIG. 2, the outboard motor 2*a* includes an engine 21, an engine control unit (ECU) 22, a shift actuator 23, and a propeller 24. The outboard motor 2*b* has the same or similar structure as the outboard motor 2*a*. The engine 21 is an internal combustion engine, for example, that generates a driving force by combustion of fuel. The engine 21 rotates a crankshaft by the generated driving force. When the crankshaft is rotated, the propeller 24 of the outboard motor 2*a* is rotated. A propulsive force P is generated by the rotation of the propeller 24, and the hull 1 moves. The shift actuator 23 moves the shift positions of the outboard motors 2*a* and 2*b* to any one of forward movement positions (F), neutral positions (N), and reverse movement positions (R) based on an operation performed on an operation lever 62*a* described below. Thus, when the engine 21 is being driven and the shift position of the outboard motor 2*a* is at the forward movement position (F), the hull 1 moves forward. When the engine 21 is being driven and the shift position of the outboard motor 2*a* is at the reverse movement position (R), the hull 1 moves rearward. When the engine 21 is being driven and the shift position of the outboard motor 2*a* is at the neutral position (N), no propulsive force P is generated for the hull 1.

The ECU 22 controls driving of the engine 21 and driving of the shift actuator 23 based on a command from the steering control system 10. For example, the ECU 22 performs each control process by executing a program stored in a memory.

As shown in FIG. 1, the main battery 4*a* supplies power to the ECU 22, a load group of engine auxiliaries (not shown), a starter motor (not shown), etc. via cables (not shown). The steering battery 4*b* supplies power to steerings 8*a* and 8*b* and a steering operator 61, which are described below, via cables (not shown).

The steering control system 10 includes a boat control unit (BCU) 5, a remote control 6, a global positioning system (GPS) device 7*a*, an electronic compass 7*b*, and the steerings 8*a* and 8*b*. The GPS device 7*a* transmits information about the detected current position of the marine vessel 100 (hull 1) and information about the current speed of the marine vessel 100 to the BCU 5. The electronic compass 7*b* transmits information about the detected current orientation of the marine vessel 100 (hull 1) to the BCU 5. The BCU 5 is an example of a "controller". The remote control 6 is an example of an "operator". The GPS device 7*a* is an example of a "position sensor". The electronic compass 7*b* is an example of an "orientation sensor".

The BCU 5 includes a control circuit including a central processing unit (CPU), for example. The BCU 5 is configured or programmed to, in an automatic marine vessel maneuvering mode M1 during movement, perform at least one of a control to automatically steer the marine vessel 100 or a control to automatically change the propulsive forces P of the outboard motors 2*a* and 2*b*. The BCU 5 may be configured or programmed to perform each control process by executing a program (software) stored in a memory (not shown), or may be configured or programmed to perform the control process as hardware (circuit structure).

Figure 3:
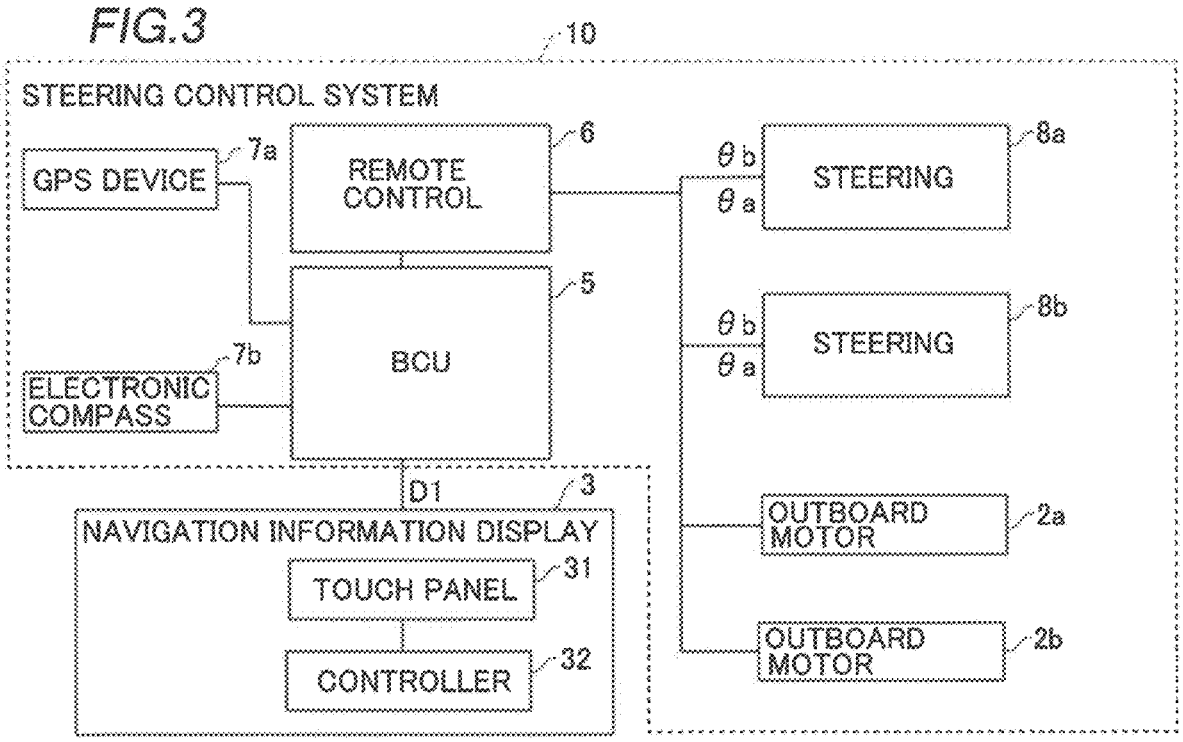
FIG. 3 is a block diagram showing the structure of a steering control system and a navigation information display according to a preferred embodiment of the present invention.

As shown in FIG. 3, the remote control 6 operates at least one of the outboard motors 2*a* and 2*b* or the BCU 5. That is, the remote control 6 operates at least one predetermined operation of operating the outboard motors 2*a* and 2*b*, starting the automatic marine vessel maneuvering mode M1 by the BCU 5, or turning on/off power supply to the outboard motors 2*a* and 2*b*. For example, the predetermined operations are to change the orientations (steering angles θ) of the outboard motors 2*a* and 2*b*, to change the propulsive forces P of the outboard motors 2*a* and 2*b*, to start the automatic marine vessel maneuvering mode M1 by the BCU 5, and to turn on/off power supply to the outboard motors 2*a* and 2*b*.

Figure 4:
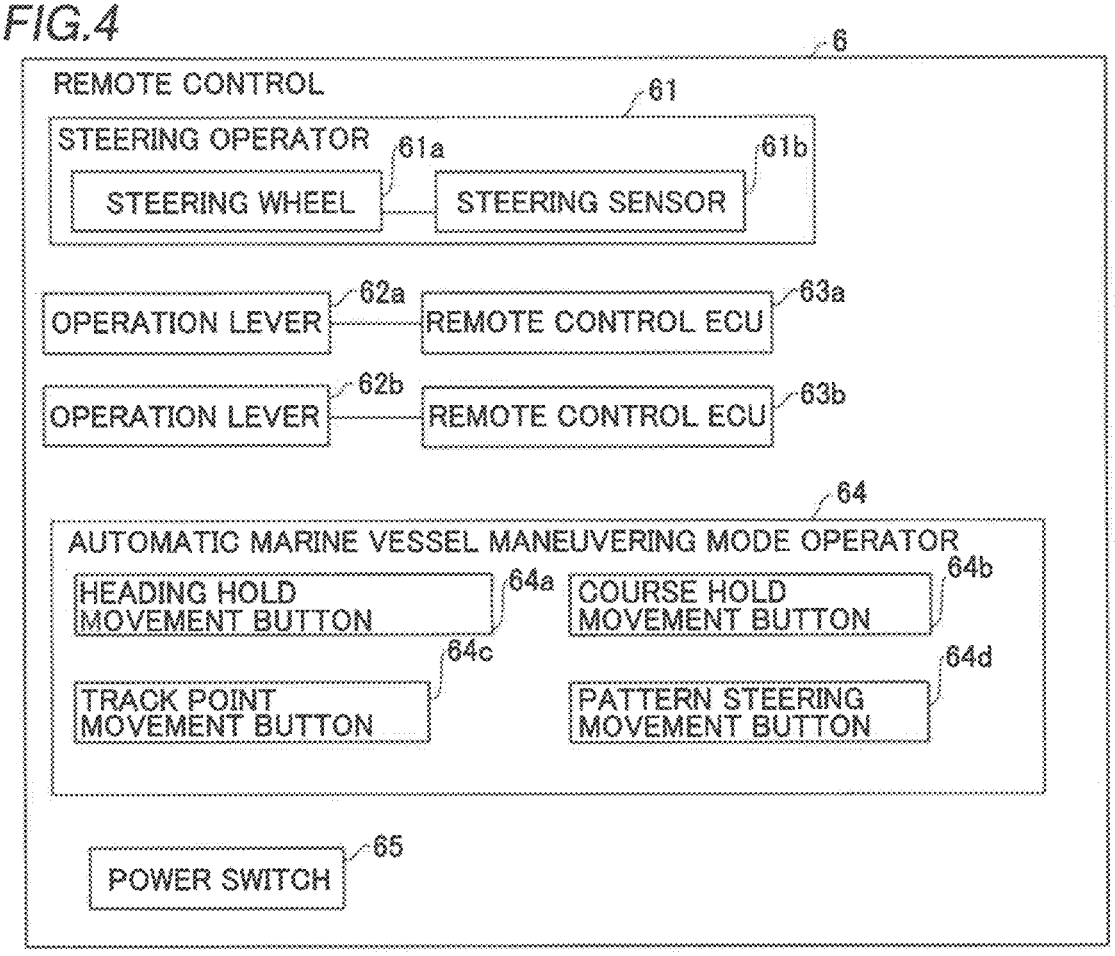
FIG. 4 is a block diagram showing the structure of a marine vessel maneuvering apparatus according to a preferred embodiment of the present invention.

As shown in FIG. 4, the remote control 6 includes the steering operator 61, operation levers 62*a* and 62*b*, remote control ECUs 63*a* and 63*b*, an automatic marine vessel maneuvering mode operator 64, and a power switch 65. The steering operator 61 and the operation levers 62*a* and 62*b* are examples of an "operator".

Figure 5:
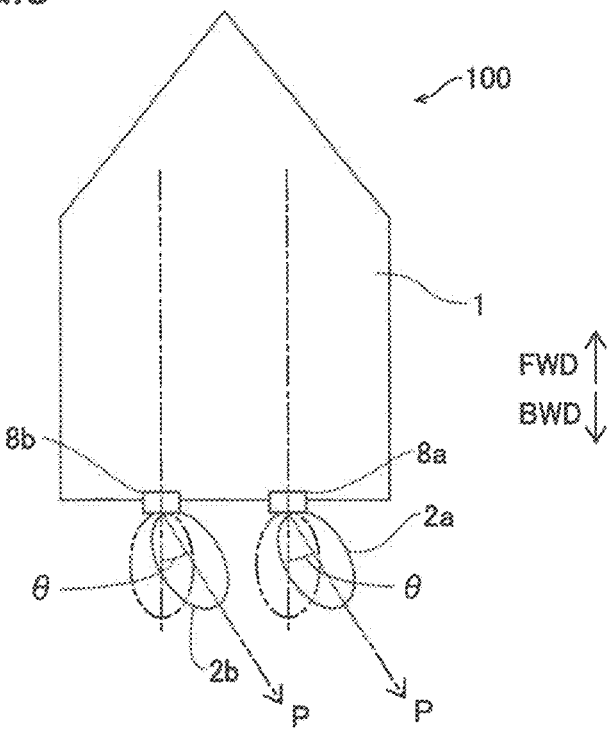
FIG. 5 is a schematic view illustrating the steering angle of a marine vessel according to a preferred embodiment of the present invention.

As shown in FIG. 5, the steering operator 61 receives an operation to change the steering angles θ of the steerings 8*a* and 8*b* that steer the marine vessel 100. Specifically, as shown in FIG. 4, the steering operator 61 includes a steering wheel 61*a* and a steering sensor 61*b*. The steering wheel 61*a* is rotatable while being gripped by a vessel operator. In the automatic marine vessel maneuvering mode M1, the steering wheel 61*a* is braked. Thus, the torque required to rotate the steering wheel 61*a* in the automatic marine vessel maneuvering mode M1 is increased as compared with the torque required to rotate the steering wheel 61*a* in a manual marine vessel maneuvering mode M2. The steering sensor 61*b* acquires the rotation angle of the steering wheel 61*a*. The steering sensor 61*b* transmits the acquired rotation angle to the BCU 5. The BCU 5 and the remote control 6 determine a steering angle command value θb based on the rotation angle in the manual marine vessel maneuvering mode M3 described below. The BCU 5 and the remote control 6 transmit the steering angle command value θb to the steerings 8*a* and 8*b*.

The operation lever 62*a* manipulates the propulsive force P of the outboard motor 2*a* via the remote control ECU 63*a*. The operation lever 62*b* controls the propulsive force P of the outboard motor 2*b* via the remote control ECU 63*b*. The operation lever 62*b* has the same or similar structure as the operation lever 62*a*.

Figure 6:
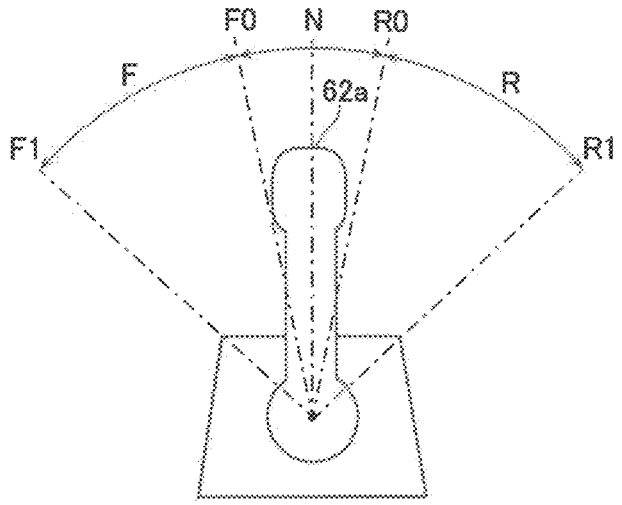
FIG. 6 is a schematic view illustrating the structure of an operation lever according to a preferred embodiment of the present invention.

As shown in FIG. 6, the operation lever 62*a* is movable to any of the forward movement position F, the neutral position N, or the reverse movement position R. For example, the operation lever 62*a* is rotated (tilted) while being gripped by the vessel operator. The operation lever 62*a* is rotated to move between the forward movement position F, the neutral position N, and the reverse movement position R. Furthermore, the operation lever 62*a* outputs a command signal to increase the forward propulsive force P as the operation lever 62*a* is rotated forward (toward F1). The operation lever 62*a* outputs a command signal to increase the rearward propulsive force P as the operation lever 62*a* is rotated rearward (toward R1). The operation lever 62*a* outputs a command signal indicating that the operation lever 62*a* is located at the neutral position N, wherein a position between a position F0 and a position R0 is defined as the neutral position N.

As shown in FIG. 4, the remote control ECU 63*a* transmits a command signal to each of the ECU 22 of the outboard motor 2*a* and the BCU 5. The remote control ECU 63*b* transmits a command signal to each of the ECU 22 of the outboard motor 2*b* and the BCU 5.

The automatic marine vessel maneuvering mode operator 64 transmits, to the BCU 5, a command signal to start the automatic marine vessel maneuvering mode M1 (autopilot mode) when operated by the vessel operator. Specifically, the automatic marine vessel maneuvering mode operator 64 includes a heading hold movement button 64*a*, a course hold movement button 64*b*, a track point movement button 64*c*, and a pattern steering movement button 64*d*.

Figure 7:
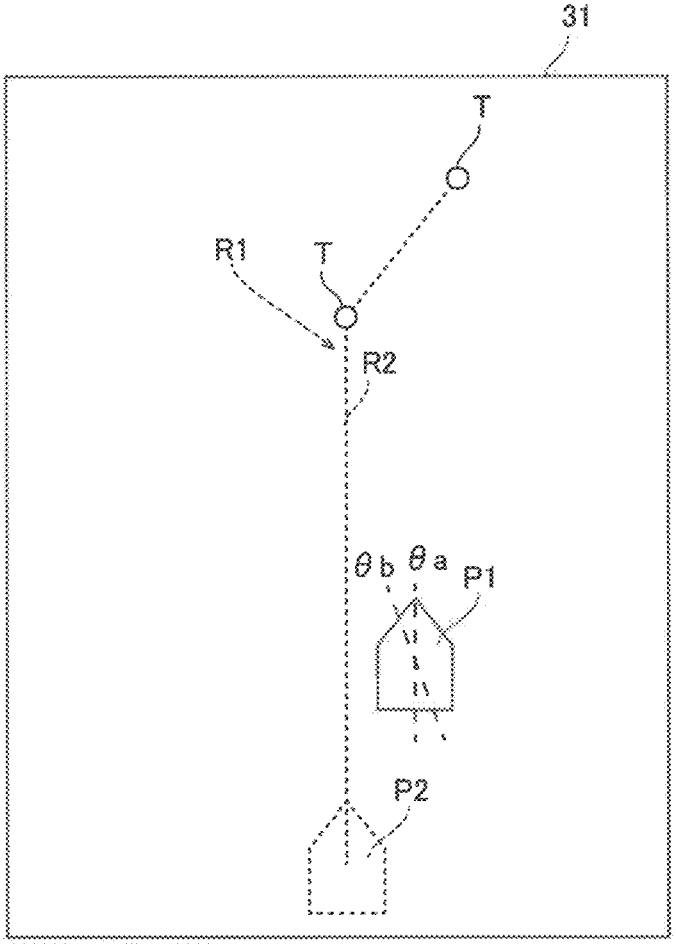
FIG. 7 is a diagram illustrating a display example of a navigation information display according to a preferred embodiment of the present invention.

The BCU 5 performs a heading hold control when the heading hold movement button 64*a* is operated (pressed, for example). The heading hold control refers to a control to move the hull 1 while maintaining the orientation of the hull 1 in the automatic marine vessel maneuvering mode M1. The BCU 5 performs a course hold control when the course hold movement button 64*b* is operated (pressed, for example). The course hold control refers to a control to move the hull 1 while maintaining the course of the hull 1 in the automatic marine vessel maneuvering mode M1. The BCU 5 performs a track point control when planned course information D1 (waypoint information) described below is acquired from the navigation information display 3 and the track point movement button 64*c* is operated (pressed, for example). The track point control refers to a control to move the hull 1 such that the hull 1 passes through a target passing point T in the automatic marine vessel maneuvering mode M1, as shown in FIG. 7. The BCU 5 performs a pattern steering control when the pattern steering movement button 64*d* is operated (pressed, for example). The pattern steering control refers to a control to move the hull 1 along a predetermined course pattern in the automatic marine vessel maneuvering mode M1.

The power switch 65 turns on/off power supply from the main battery 4*a* to the outboard motors 2*a* and 2*b* (such as the auxiliaries or the ECU 22). The BCU 5 is connected to the power switch 65. The BCU 5 acquires information about whether or not the power switch 65 is on.

As shown in FIG. 3, the steering 8*a* changes the orientation of the outboard motor 2*a* with respect to the hull 1 based on the steering angle command value θb. The steering 8*a* steers the marine vessel 100 (hull 1) by changing the orientation of the outboard motor 2*a*. The steering 8*b* steers the marine vessel 100 (hull 1) by changing the orientation of the outboard motor 2*b* with respect to the hull 1 based on the steering angle command value θb.

The navigation information display 3 acquires position information and speed information from the GPS device 7*a* of the steering control system 10. The navigation information display 3 acquires orientation information from the electronic compass 7*b* of the steering control system 10. The navigation information display 3 provides, on a touch panel 31, a display of a planned course R1 that is a route along which the marine vessel 100 is scheduled to travel, a current position display P1 indicating the current position of the marine vessel 100, and a past position display P2 indicating the past position of the marine vessel 100. A controller 32 transmits the planned course information D1, which is information about the planned course R1, to the BCU 5 of the steering control system 10.

The BCU 5 is configured or programmed to perform any of the heading hold control, the course hold control, the track point control, and the pattern steering control in the automatic marine vessel maneuvering mode M1. In the automatic marine vessel maneuvering mode M1 of the BCU 5, both the operation levers 62*a* and 62*b* are located at the forward movement positions F. For example, the BCU 5 determines a target course R2 based on the planned course information D1 (planned course R1).

Specifically, the BCU 5 is configured or programmed to control the propulsive force P of each of the outboard motors 2*a* and 2*b* and the steering angle θ of each of the steerings 8*a* and 8*b* (see FIG. 9) based on the planned course information D1 (planned course R1) acquired from the navigation information display 3, the position information and the speed information acquired from the GPS device 7*a*, and the orientation information acquired from the electronic compass 7*b*. The BCU 5 performs any of the heading hold control, the course hold control, the track point control, and the pattern steering control by controlling the propulsive forces P and the steering angles θ.

Specifically, the BCU 5 is configured or programmed to set at least one of a target steering angle θa or a target speed Vb in the automatic marine vessel maneuvering mode M1. The BCU 5 acquires the current target steering angle θa from the remote control 6. Then, the BCU 5 controls the operation of the steerings 8*a* and 8*b* via the remote control 6 such that the steering angles θ of the steerings 8*a* and 8*b* become a newly set target steering angle θa. Specifically, the BCU 5 determines the steering angle command value θb based on the current target steering angle θa. Then, the BCU 5 transmits the determined steering angle command value θb to the steerings 8*a* and 8*b* via the remote control 6. For example, in the heading hold control, the target steering angle θa is set such that the orientation of the hull 1 becomes the planned orientation. In the course hold control, the track point control, and the pattern steering control, at least the target steering angle θa of the target steering angle θa and the target speed Vb is set such that the marine vessel 100 navigates along the planned course R1.

The BCU 5 acquires a current speed Va from the GPS device 7*a*. Then, the BCU 5 controls the operation of the outboard motors 2*a* and 2*b* via the remote control 6 such that the speed V of the marine vessel 100 becomes the target speed Vb based on the current speed Va. That is, the BCU 5 is configured or programmed to perform a feedback control on the steering angles θ of the steerings 8*a* and 8*b* and the speed V of the marine vessel 100. The "speed V" may be a ground speed (vessel speed) at which the hull 1 is traveling, or may be an engine speed.

The BCU 5 is configured or programmed to, when the marine vessel 100 is moving in the automatic marine vessel maneuvering mode M1, perform a control to disable a control to determine the steering angle command value θb based on an operation on the steering wheel 61*a* when performing a control to automatically steer the marine vessel 100. Furthermore, the BCU 5 is configured or programmed to perform a control to disable a control to determine the propulsive forces P based on operations on the operation levers 62*a* and 62*b* when performing a control to automatically change the propulsive forces P of the outboard motors 2*a* and 2*b*.

Figure 8:
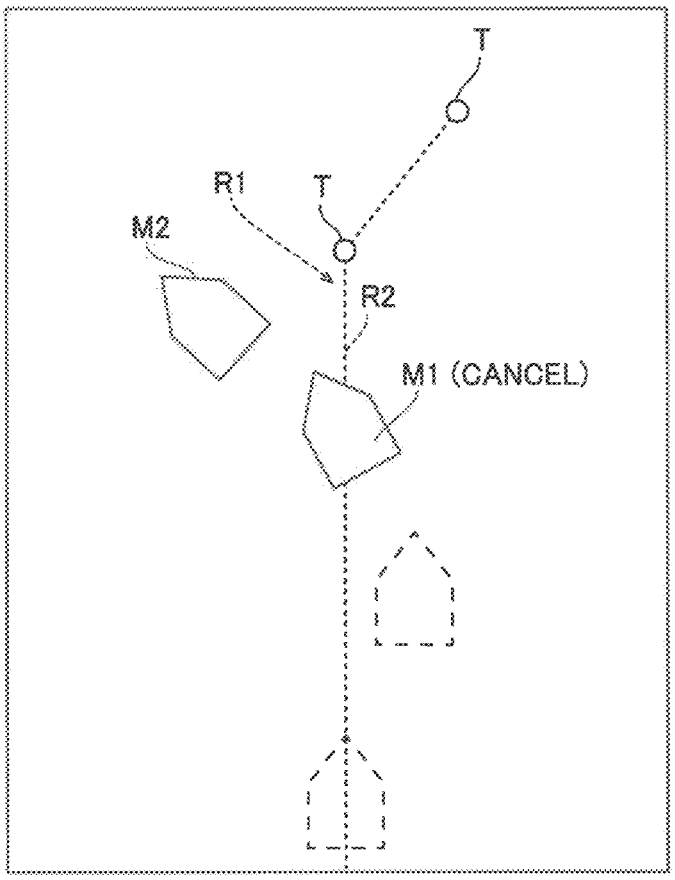
FIG. 8 is a schematic view illustrating an automatic marine vessel maneuvering mode and a manual marine vessel maneuvering mode according to a preferred embodiment of the present invention.

In a preferred embodiment of the present invention, as shown in FIGS. 4 and 8, the BCU 5 is configured or programmed to cancel the automatic marine vessel maneuvering mode M1 based on an operation performed on the remote control 6 by the vessel operator to perform the predetermined operation described above when the marine vessel 100 is moving in the automatic marine vessel maneuvering mode M1.

In a preferred embodiment of the present invention, the BCU 5 cancels the automatic marine vessel maneuvering mode M1 based on at least one of an operation performed on the steering operator 61 by the vessel operator to steer the marine vessel 100 or an operation performed on the operation lever 62*a* or 62*b* by the vessel operator to manipulate the propulsive force P of the outboard motor 2*a* or 2*b* when the marine vessel 100 is moving in the automatic marine vessel maneuvering mode M1. As shown in FIG. 8, the BCU 5 cancels the automatic marine vessel maneuvering mode M1 and starts the manual marine vessel maneuvering mode M2.

The BCU 5 cancels the automatic marine vessel maneuvering mode M1 based on the operation levers 62*a* and 62*b* being moved from the forward movement positions F to either the neutral positions N or the reverse movement positions R by the vessel operator during movement of the marine vessel 100 in the automatic marine vessel maneuvering mode M1.

Specifically, the BCU 5 cancels the automatic marine vessel maneuvering mode M1 based on both (all) of the operation levers 62*a* and 62*b* being moved to the neutral positions N by the vessel operator during movement of the marine vessel 100 in the automatic marine vessel maneuvering mode M1. That is, the BCU 5 cancels the automatic marine vessel maneuvering mode M1 based on both (all) the operation levers 62*a* and 62*b* being moved from the forward movement positions F to the neutral positions N by the vessel operator when both the operation levers 62*a* and 62*b* are at the forward movement positions F during movement of the marine vessel 100 in the automatic marine vessel maneuvering mode M1.

The BCU 5 cancels the automatic marine vessel maneuvering mode M1 based on either the operation lever 62*a* or 62*b* being moved to the reverse movement position R by the vessel operator during movement of the marine vessel 100 in the automatic marine vessel maneuvering mode M1. That is, even when both of the operation levers 62*a* and 62*b* are located at the forward movement positions F during movement of the marine vessel 100 in the automatic marine vessel maneuvering mode M1, the BCU 5 cancels the automatic marine vessel maneuvering mode M1 based on either the operation lever 62*a* or 62*b* being moved from the forward movement position F to the reverse movement position R.

The BCU 5 cancels the automatic marine vessel maneuvering mode M1 based on rotation of the steering wheel 61*a* by the vessel operator during movement of the marine vessel 100 in the automatic marine vessel maneuvering mode. For example, the BCU 5 acquires the rotation speed Vc of the steering wheel 61*a*. Then, the BCU 5 cancels the automatic marine vessel maneuvering mode M1 based on the rotation speed Vc of the steering wheel 61*a* rotated by the vessel operator becoming equal to or higher than a rotation speed threshold Vt. That is, the BCU 5 continues the automatic marine vessel maneuvering mode M1 when the rotation speed Vc of the steering wheel 61*a* is lower than the rotation speed threshold Vt even when the steering wheel 61*a* is operated by the vessel operator (even when an object or a person touches the steering wheel 61*a*).

The BCU 5 cancels the automatic marine vessel maneuvering mode M1 based on an operation on the automatic marine vessel maneuvering mode operator 64 during movement of the marine vessel 100 in the automatic marine vessel maneuvering mode M1. Specifically, the BCU 5 cancels the automatic marine vessel maneuvering mode M1 based on an operation on any one of the heading hold movement button 64*a*, the course hold movement button 64*b*, the track point movement button 64*c*, and the pattern steering movement button 64*d*. For example, the BCU 5 cancels the automatic marine vessel maneuvering mode M1 based on an operation on the automatic marine vessel maneuvering mode operator 64 corresponding to a running control among the heading hold control, the course hold control, the track point control, and the pattern steering control. Alternatively, the BCU 5 cancels the automatic marine vessel maneuvering mode M1 based on an operation on the automatic marine vessel maneuvering mode operator 64 that is different from the automatic marine vessel maneuvering mode operator 64 corresponding to the running control.

The BCU 5 cancels the automatic marine vessel maneuvering mode M1 based on an operation on the power switch 65 during movement of the marine vessel 100 in the automatic marine vessel maneuvering mode M1. That is, the BCU 5 cancels the automatic marine vessel maneuvering mode M1 based on whether or not power is supplied to the outboard motors 2*a* and 2*b*.

The BCU 5 detects an abnormality in at least one of the GPS device 7*a* or the electronic compass 7*b*. Then, the BCU 5 cancels the automatic marine vessel maneuvering mode M1 based on the abnormality detected in at least one of the GPS device 7*a* or the electronic compass 7*b* during movement of the marine vessel 100 in the automatic marine vessel maneuvering mode M1.

Figure 9:
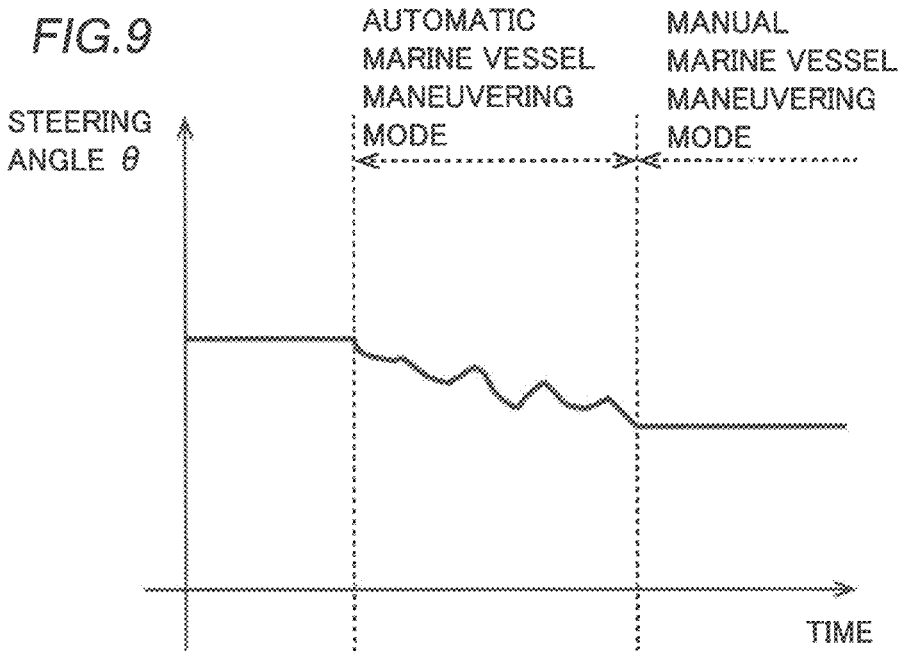
FIG. 9 is a diagram illustrating an example of steering angle control according to a preferred embodiment of the present invention.

As shown in FIG. 8, the BCU 5 starts the manual marine vessel maneuvering mode M2 upon canceling the automatic marine vessel maneuvering mode M1. In the manual marine vessel maneuvering mode M2, the BCU 5 performs a control to change the propulsive forces P of the outboard motors 2*a* and 2*b* by manual operations performed on the operation levers 62*a* and 62*b*. Furthermore, the BCU 5 performs a control to change the steering angles θ of the steerings 8*a* and 8*b* by a manual operation performed on the steering wheel 61*a* of the remote control 6 in the manual marine vessel maneuvering mode M2. In other words, as shown in FIG. 9, the BCU 5 performs a control to enable an operation on the steering operator 61 which has been disabled in the automatic marine vessel maneuvering mode M1. Furthermore, the BCU 5 performs a control to enable operations on the operation levers 62*a* and 62*b* which have been disabled in the automatic marine vessel maneuvering mode M1.

The BCU 5 cancels the manual marine vessel maneuvering mode M2 based on an operation performed on the automatic marine vessel maneuvering mode operator 64 when the BCU 5 is performing a control in the manual marine vessel maneuvering mode M2 and at least one of the operation lever 62*a* or 62*b* is moved from either the neutral position N or the reverse movement position R to the forward movement position F. Then, the BCU 5 starts or restarts the automatic marine vessel maneuvering mode M1. For example, the BCU 5 cancels the manual marine vessel maneuvering mode M2, and starts or restarts the automatic marine vessel maneuvering mode M1 based on an operation performed on the automatic marine vessel maneuvering mode operator 64 when the BCU 5 is performing a control in the manual marine vessel maneuvering mode M2, and both the operation levers 62*a* and 62*b* are at the forward movement positions F or one of the operation levers 62*a* and 62*b* is at the forward movement position F and the other of the operation levers 62*a* and 62*b* is at the neutral position N. When performing the track point control, the BCU 5 starts or restarts the automatic marine vessel maneuvering mode M1 when the planned course information D1 is acquired from the navigation information display 3 and an operation is performed on the automatic marine vessel maneuvering mode operator 64. In this case, the BCU 5 performs a control (any of the heading hold control, the course hold control, the track point control, and the pattern steering control) corresponding to an operated operator (any of the heading hold movement button 64*a*, the course hold movement button 64*b*, the track point movement button 64*c*, and the pattern steering movement button 64*d*) of the automatic marine vessel maneuvering mode operator 64.

A steering control method of the marine vessel 100 according to preferred embodiments of the present invention is now described with reference to FIG. 10. FIG. 8 shows a flowchart of a control process of the steering control system 10. For example, an example in which steering of the marine vessel 100 (the steering angles θ of the steerings 8*a* and 8*b*) is automatically controlled is described.

In step S1, it is determined whether or not an operation to start or restart the automatic marine vessel maneuvering mode M1 has been received. When the operation to start or restart the automatic marine vessel maneuvering mode M1 has been received, the process advances to step S2. This determination is repeated until the operation to start or restart the automatic marine vessel maneuvering mode M1 is received. Furthermore, until the automatic marine vessel maneuvering mode M1 is started, a control is performed in the manual marine vessel maneuvering mode M2.

In step S2, a control in the automatic marine vessel maneuvering mode M1 is started or restarted. That is, the manual marine vessel maneuvering mode M2 is switched to the automatic marine vessel maneuvering mode M1. Thus, the marine vessel 100 starts to move in the automatic marine vessel maneuvering mode M1. Then, the process advances to step S3.

In step S3, the current target steering angle θa is acquired. Specifically, the current target steering angle θa is acquired from the remote control 6. Then, the process advances to step S4.

In step S4, the steering angle command value θb is reset. Then, the process advances to step S5.

In step S5, a new target steering angle θa is determined. That is, a new target steering angle θa is determined based on the planned course information D1 and the position information acquired from the navigation information display 3. Then, the process advances to step S6.

In step S6, the steering angle command value θb is determined. That is, the steering angle command value θb is determined by the feedback control. Then, the process advances to step S7.

In step S7, the steerings 8*a* and 8*b* are operated based on the steering angle command value θb. Specifically, the steerings 8*a* and 8*b* change the orientations (steering angles θ) of the outboard motors 2*a* and 2*b* with respect to the hull 1 to steer the marine vessel 100. Then, the process advances to step S8.

In step S8, it is determined whether or not the target course R2 has been changed. When the target course R2 has been changed (in the case of Yes), the process returns to step S5, and when the target course R2 has not been changed (in the case of No), the process advances to step S9. It is determined based on the planned course information D1 whether or not the target course R2 has been changed.

In step S9, it is determined whether or not an operation to cancel the automatic marine vessel maneuvering mode M1 has been received. When the operation to cancel the automatic marine vessel maneuvering mode M1 has been received (in the case of Yes), the process advances to step S11, and when the operation to cancel the automatic marine vessel maneuvering mode M1 has not been received (in the case of No), the process advances to step S10.

In step S10, it is determined whether or not an abnormality has been detected in at least one of the GPS device 7*a* or the electronic compass 7*b*. When an abnormality has been detected in at least one of the GPS device 7*a* or the electronic compass 7*b*, the process advances to step S11, and when an abnormality has not been detected in at least one of the GPS device 7*a* or the electronic compass 7*b*, the process returns to step S6.

In step S11, the automatic marine vessel maneuvering mode M1 is canceled. That is, the automatic marine vessel maneuvering mode M1 is switched to the manual marine vessel maneuvering mode M2. Then, the process advances to step S12.

In step S12, the feedback control on the steering angle command value θb is terminated. Then, the process advances to step S13.

In step S13, the steering angle command value θb is reset. Then, the process returns to step S1. That is, when the manual marine vessel maneuvering mode M2 has been started and an operation to start or restart the automatic marine vessel maneuvering mode M1 has been received in step S1, the automatic marine vessel maneuvering mode M1 is restarted.

In the structure according to the various preferred embodiments described above, the following advantageous effects are achieved.

According to a preferred embodiment of the present invention, as described above, the BCU 5 is configured or programmed to cancel the automatic marine vessel maneuvering mode M1 based on an operation performed on the remote control 6 by the vessel operator to perform the predetermined operation during movement of the marine vessel 100 in the automatic marine vessel maneuvering mode M1. Accordingly, the automatic marine vessel maneuvering mode M1 is canceled based on the operation performed on the existing remote control 6 of the steering control system 200 of the marine vessel 100 by the vessel operator without newly providing a dedicated operator to cancel the automatic marine vessel maneuvering mode M1 in the steering control system 10 of the marine vessel 100. Consequently, the automatic marine vessel maneuvering mode M1 is canceled based on the operation performed by the vessel operator while a complex structure of the steering control system 10 of the marine vessel 100 is significantly reduced or prevented.

According to a preferred embodiment of the present invention, as described above, the remote control 6 includes the steering operator 61 to steer the marine vessel 100 and the operation levers 62*a* and 62*b* to manipulate the propulsive forces P of the outboard motors 2*a* and 2*b*. The BCU 5 is configured or programmed to cancel the automatic marine vessel maneuvering mode M1 based on an operation performed on at least one of the steering operator 61 or the operation levers 62*a* and 62*b* by the vessel operator during movement of the marine vessel 100 in the automatic marine vessel maneuvering mode M1. Accordingly, when the marine vessel 100 is moving in the automatic marine vessel maneuvering mode M1, the vessel operator easily cancels the automatic marine vessel maneuvering mode M1 by operating at least one of the steering operator 61 or the operation levers 62*a* and 62*b*. When a manual control is performed by at least one of the steering operator 61 or the operation levers 62*a* and 62*b* (when the automatic marine vessel maneuvering mode M1 is switched to the manual marine vessel maneuvering mode M2) after the automatic marine vessel maneuvering mode M1 is canceled, the manual operation (manual marine vessel maneuvering mode M2) is quickly started by at least one of the steering operator 61 or the operation levers 62*a* and 62*b* used to cancel the automatic marine vessel maneuvering mode M1 after the automatic marine vessel maneuvering mode M1 is canceled.

According to a preferred embodiment of the present invention, as described above, the operation levers 62*a* and 62*b* are movable to any of the forward movement positions, the neutral positions, and the reverse movement positions. The BCU 5 is configured or programmed to cancel the automatic marine vessel maneuvering mode M1 based on the operation levers 62*a* and 62*b* being moved from the forward movement positions F to either the neutral positions N or the reverse movement positions R by the vessel operator during movement of the marine vessel 100 in the automatic marine vessel maneuvering mode M1. Accordingly, when the vessel operator intends to cancel the automatic marine vessel maneuvering mode M1, the vessel operator easily cancels the automatic marine vessel maneuvering mode M1 by moving the operation levers 62*a* and 62*b* from the forward movement positions F to either the neutral positions N or the reverse movement positions R. When a manual control is performed by the operation levers 62*a* and 62*b* after the automatic marine vessel maneuvering mode M1 is canceled, the manual operation (control) is quickly started by the operation levers 62*a* and 62*b* used to cancel the automatic marine vessel maneuvering mode M1 after the automatic marine vessel maneuvering mode M1 is canceled.

According to a preferred embodiment of the present invention, as described above, the remote control 6 includes the operation levers 62*a* and 62*b*. The BCU 5 is configured or programmed to cancel the automatic marine vessel maneuvering mode M1 based on both of the operation levers 62*a* and 62*b* being moved to the neutral positions N during movement of the marine vessel 100 in the automatic marine vessel maneuvering mode M1. Accordingly, even when the operation levers 62*a* and 62*b* are provided in the steering control system 10 of the marine vessel 100, the vessel operator easily cancels the automatic marine vessel maneuvering mode M1 by moving both the operation levers 62*a* and 62*b* to the neutral positions N.

According to a preferred embodiment of the present invention, as described above, the remote control 6 includes the operation levers 62*a* and 62*b*. The BCU 5 is configured or programmed to cancel the automatic marine vessel maneuvering mode M1 based on at least one of the operation levers 62*a* and 62*b* being moved to the reverse movement position R during movement of the marine vessel 100 in the automatic marine vessel maneuvering mode M1. Accordingly, even when the operation levers 62*a* and 62*b* are provided in the steering control system 10 of the marine vessel 100, the vessel operator more easily cancels the automatic marine vessel maneuvering mode M1 by moving at least one of the operation lever 62*a* or 62*b* to the reverse movement position R.

According to a preferred embodiment of the present invention, as described above, the steering operator 61 includes the steering wheel 61*a*. The BCU 5 is configured or programmed to cancel the automatic marine vessel maneuvering mode M1 based on the steering wheel 61*a* being rotated by the vessel operator during movement of the marine vessel 100 in the automatic marine vessel maneuvering mode M1. Accordingly, the steering wheel 61*a* is rotated such that the automatic marine vessel maneuvering mode M1 is easily canceled. When a manual control is performed by the steering wheel 61*a* after the automatic marine vessel maneuvering mode M1 is canceled, the manual operation (control) is quickly started by the steering wheel 61*a* used to cancel the automatic marine vessel maneuvering mode M1 after the automatic marine vessel maneuvering mode M1 is canceled.

According to a preferred embodiment of the present invention, as described above, the remote control 6 includes the automatic marine vessel maneuvering mode operator 64 to start the automatic marine vessel maneuvering mode M1. The BCU 5 is configured or programmed to cancel the automatic marine vessel maneuvering mode M1 based on an operation performed on the automatic marine vessel maneuvering mode operator 64 by the vessel operator during movement of the marine vessel 100 in the automatic marine vessel maneuvering mode M1. Accordingly, when the vessel operator intends to cancel the automatic marine vessel maneuvering mode M1, the vessel operator easily cancels the automatic marine vessel maneuvering mode M1 by operating the automatic marine vessel maneuvering mode operator 64.

According to a preferred embodiment of the present invention, as described above, the remote control 6 includes the power switch 65 to turn on/off power supply from the steering battery 4*b* to the outboard motors 2*a* and 2*b*. The BCU 5 is configured or programmed to cancel the automatic marine vessel maneuvering mode M1 based on an operation performed on the power switch 65 by the vessel operator during movement of the marine vessel 100 in the automatic marine vessel maneuvering mode M1. Accordingly, when the vessel operator intends to cancel the automatic marine vessel maneuvering mode M1, the vessel operator easily cancels the automatic marine vessel maneuvering mode M1 by operating the power switch 65.

According to a preferred embodiment of the present invention, as described above, the marine vessel 100 includes the electronic compass 7*b* to detect the orientation of the hull 1 and the GPS device 7*a* to detect the position of the hull. The BCU 5 is configured or programmed to detect an abnormality in at least one of the electronic compass 7*b* or the GPS device 7*a* and cancel the automatic marine vessel maneuvering mode M1 based on the abnormality detected in at least one of the electronic compass 7*b* or the GPS device 7*a* during movement of the marine vessel 100 in the automatic marine vessel maneuvering mode M1. Accordingly, when an abnormality occurs in the electronic compass 7*b* or the GPS device 7*a* during movement of the marine vessel 100 in the automatic marine vessel maneuvering mode M1, continuation of the automatic marine vessel maneuvering mode M1 is significantly reduced or prevented.

According to a preferred embodiment of the present invention, as described above, the remote control 6 includes the automatic marine vessel maneuvering mode operator 64 to start the automatic marine vessel maneuvering mode M1 and the operation levers 62*a* and 62*b* to manipulate the propulsive forces P of the outboard motors 2*a* and 2*b*. The operation levers 62*a* and 62*b* are movable to any of the forward movement positions F, the neutral positions N, and the reverse movement positions R. The BCU 5 is configured or programmed to cancel the automatic marine vessel maneuvering mode M1 based on the operation levers 62*a* and 62*b* being moved from the forward movement positions F to either the neutral positions N or the reverse movement positions R by the vessel operator during movement of the marine vessel 100 in the automatic marine vessel maneuvering mode M1, and to start the manual marine vessel maneuvering mode M2 to change the propulsive forces P of the outboard motors 2*a* and 2*b* by manual operations on the operation levers 62*a* and 62*b*. The BCU 5 is configured or programmed to cancel the manual marine vessel maneuvering mode M2 based on the operation levers 62*a* and 62*b* being moved from either the neutral positions N or the reverse movement positions R to the forward movement positions F by the vessel operator during movement of the marine vessel 100 in the manual marine vessel maneuvering mode M2 and the automatic marine vessel maneuvering mode operator 64 being operated by the vessel operator during movement of the marine vessel 100 in the manual marine vessel maneuvering mode M2, and to restart the automatic marine vessel maneuvering mode M1. Accordingly, when the vessel operator intends to start the manual marine vessel maneuvering mode M2 using the operation levers 62*a* and 62*b*, the vessel operator easily starts the manual marine vessel maneuvering mode M2 by moving the operation levers 62*a* and 62*b* from the forward movement positions F to either the neutral positions N or the reverse movement positions R. With the structure according to the present preferred embodiment, the automatic marine vessel maneuvering mode M1 is not restarted when the vessel operator moves the operation levers 62*a* and 62*b* to the forward movement positions F without intending to restart the automatic marine vessel maneuvering mode M1. Thus, restart of the automatic marine vessel maneuvering mode M1 contrary to the intention of the vessel operator is significantly reduced or prevented.

According to a preferred embodiment of the present invention, as described above, the BCU 5 is configured or programmed to perform any of a control to move the hull 1 while maintaining the orientation of the hull 1, a control to move the hull 1 while maintaining the course of the hull 1, a control to move the hull 1 such that the hull 1 passes through the target passing point T, and a control to move the hull 1 along the predetermined course pattern in the automatic marine vessel maneuvering mode M1. Accordingly, when any of the control to move the hull 1 while maintaining the orientation of the hull 1, the control to move the hull 1 while maintaining the course of the hull 1, the control to move the hull 1 such that the hull 1 passes through the target passing point T, and the control to move the hull 1 along the predetermined course pattern is performed during movement of the marine vessel 100, the automatic marine vessel maneuvering mode M1 is easily canceled according to the intention of the vessel operator.

In the control method according to the various preferred embodiments described above, the following advantageous effects are achieved.

According to a preferred embodiment of the present invention, the steering control method of the marine vessel 100 as described above enables easy cancellation of the automatic marine vessel maneuvering mode M1 during movement of the marine vessel 100 according to the intention of the vessel operator, similarly to the steering control system 10 of the marine vessel 100.

The preferred embodiments of the present invention described above are illustrative in all points and not restrictive. The extent of the present invention is not defined by the above description of the preferred embodiments but by the scope of the claims, and all modifications (modified examples) within the meaning and range equivalent to the scope of the claims are further included.

For example, while the example in which the marine vessel 100 is an outboard motor boat has been shown in preferred embodiments described above, the present invention is not restricted to this. That is, the marine vessel may be a marine vessel other than an outboard motor boat. For example, the marine vessel may be a marine vessel including an inboard motor(s), an inboard-outboard motor(s), or a jet propulsion device(s).

Figure 10:
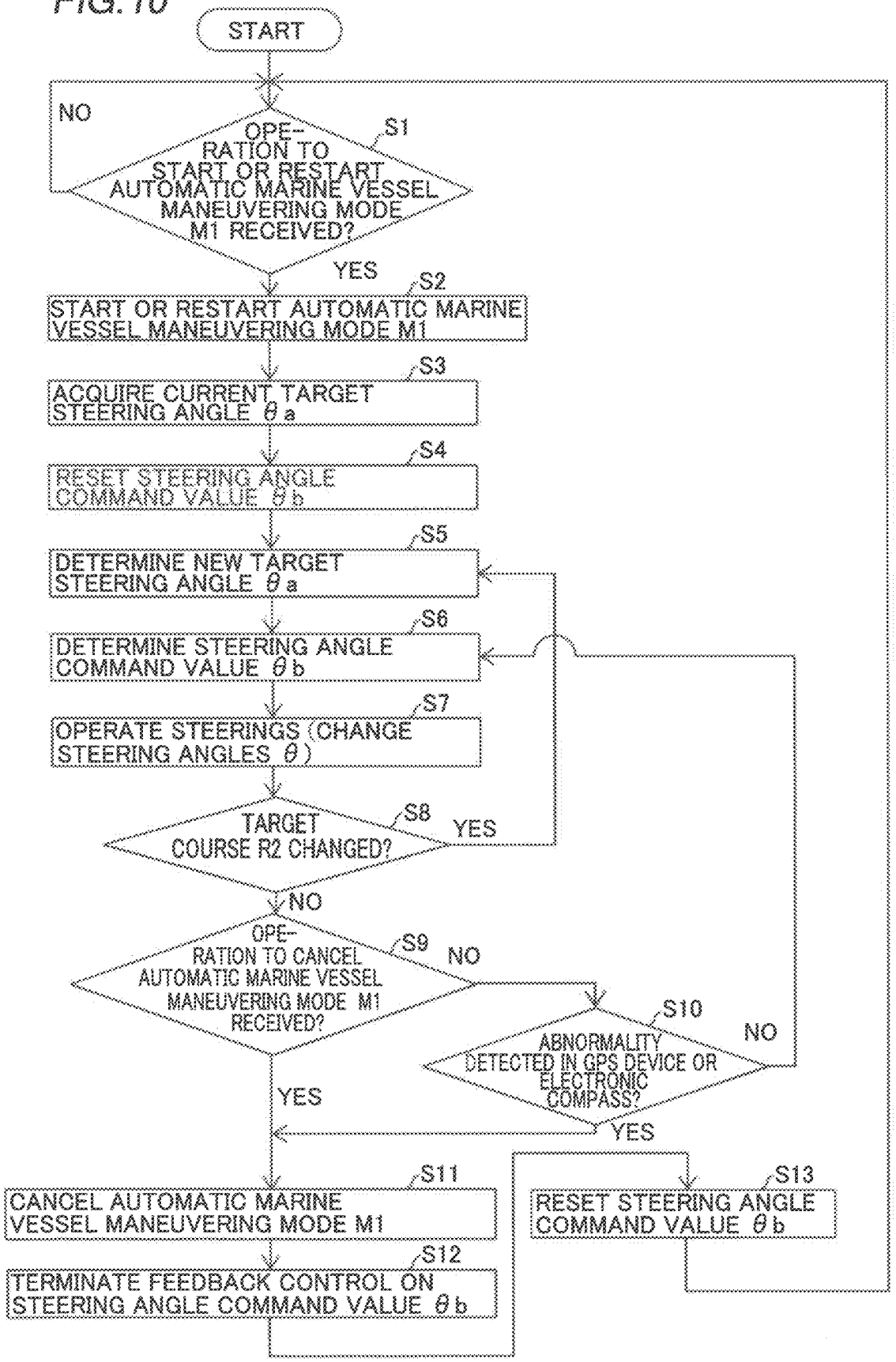
FIG. 10 is a flowchart illustrating a steering control method of a marine vessel according to a preferred embodiment of the present invention.

While the steering angles θ are automatically controlled in the control method (flowchart) of FIG. 10 in preferred embodiments described above, the present invention is not restricted to this. That is, the propulsive forces P of the outboard motors 2*a* and 2*b* may be automatically controlled without automatically controlling the steering angles θ, or the propulsive forces P of the outboard motors 2*a* and 2*b* may be automatically controlled while the steering angles θ are automatically controlled.

While the example in which the BCU 5 is configured or programmed to cancel the automatic marine vessel maneuvering mode M1 by an operation on any of the steering operator 61, the operation levers 62*a* and 62*b*, the automatic marine vessel maneuvering mode operator 64, and the power switch 65 has been shown in preferred embodiments described above, the present invention is not restricted to this. That is, the BCU 5 may be configured or programmed to cancel the automatic marine vessel maneuvering mode M1 by only an operation on a specified operator (the operation levers 62*a* and 62*b*, for example) among the steering operator 61, the operation levers 62*a* and 62*b*, the automatic marine vessel maneuvering mode operator 64, and the power switch 65.

While the example in which the remote control 6 includes two operation levers (operation levers 62*a* and 62*b*) has been shown in preferred embodiments described above, the present invention is not restricted to this. That is, the marine vessel maneuvering apparatus may include one or three or more operation levers.

While the example in which the BCU 5 is configured or programmed to cancel the automatic marine vessel maneuvering mode M1 when both the operation levers 62*a* and 62*b* are moved to the neutral positions N has been shown in preferred embodiments described above, the present invention is not restricted to this. That is, the BCU 5 may be configured or programmed to cancel the automatic marine vessel maneuvering mode M1 when one of the operation levers 62*a* and 62*b* is moved to the neutral position N.

While the example in which the BCU 5 is configured or programmed to cancel the automatic marine vessel maneuvering mode M1 based on the steering wheel 61*a* being rotated by the vessel operator has been shown in preferred embodiments described above, the present invention is not restricted to this. That is, the BCU 5 may be configured or programmed to cancel the automatic marine vessel maneuvering mode M1 based on the amount of movement of the steering wheel 61*a*. For example, the amount of movement refers to the amount of rotation (degrees) of the steering wheel 61*a*. Specifically, the marine vessel may include an angle sensor to detect the rotational position of the steering wheel 61*a*. The BCU 5 may be configured or programmed to store the angle of the steering wheel 61*a* at the start of the automatic marine vessel maneuvering mode M1 detected by the angle sensor, and cancel the automatic marine vessel maneuvering mode M1 when the steering wheel 61*a* is rotated by ±10 degrees or more of the stored angle. Alternatively, the BCU 5 may be configured or programmed to acquire the steering torque of the steering wheel 61*a* and cancel the automatic marine vessel maneuvering mode M1 based on the steering torque.

While the example in which the BCU 5 is configured or programmed to cancel the automatic marine vessel maneuvering mode M1 when at least one of the operation lever 62*a* or 62*b* is moved to the reverse movement position R has been shown in preferred embodiments described above, the present invention is not restricted to this. That is, the BCU 5 may be configured or programmed to cancel the automatic marine vessel maneuvering mode M1 when both the operation levers 62*a* and 62*b* are moved to the reverse movement positions R.

While the example in which the power switch 65 turns on/off power supply from the main battery 4*a* to the outboard motors 2*a* and 2*b* has been shown in preferred embodiments described above, the present invention is not restricted to this. For example, the power switch 65 may supply power from a power source other than the main battery 4*a* to a component other than the outboard motors 2*a* and 2*b*.

While the example in which the electronic compass 7*b* is used as an orientation sensor, and the GPS device is used as a position sensor has been shown in preferred embodiments described above, the present invention is not restricted to this. For example, an orientation sensor other than the electronic compass may be used, and a position sensor other than the GPS device may be used.

While the example in which a control to move the hull 1 while maintaining the orientation of the hull 1, a control to move the hull 1 while maintaining the course of the hull 1, a control to move the hull 1 such that the hull 1 passes through the target passing point T, and a control to move the hull 1 along the predetermined course pattern are performed as a control in the automatic marine vessel maneuvering mode M1 has been shown in preferred embodiments described above, the present invention is not restricted to this. That is, the BCU 5 may be configured or programmed to perform only one of the above controls. Alternatively, the present invention may be applied to an automatic marine vessel maneuvering control other than the above controls.

While the example in which in the automatic marine vessel maneuvering mode M1, a state in which both the operation levers 62*a* and 62*b* are moved to the forward movement positions F is changed to a state in which both the operation levers 62*a* and 62*b* are located at the neutral positions N to cancel the automatic marine vessel maneuvering mode M1 has been shown in preferred embodiments described above, the present invention is not restricted to this. That is, in the automatic marine vessel maneuvering mode M1, a state in which one of the operation levers 62*a* and 62*b* is moved to the forward movement position F and the other of the operation levers 62*a* and 62*b* is moved to the neutral position N may be changed to a state in which both the operation levers 62*a* and 62*b* are located at the neutral positions N to cancel the automatic marine vessel maneuvering mode M1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A steering control system for a marine vessel, the steering control system comprising:

a controller configured or programmed to perform at least one of a control to automatically steer the marine vessel or a control to automatically change a propulsive force of a propulsion device in an automatic marine vessel maneuvering mode during movement of the marine vessel; and an operator to perform at least one predetermined operation of operating the propulsion device, starting the automatic marine vessel maneuvering mode by the controller, turning on/off power supply to the propulsion device, or steering the marine vessel; wherein the controller is configured or programmed to cancel the automatic marine vessel maneuvering mode based on an operation performed on the operator by a vessel operator to perform the predetermined operation during the movement of the marine vessel in the automatic marine vessel maneuvering mode;

the operator includes a steering operator to steer the marine vessel; and the controller is configured or programmed to cancel the automatic marine vessel maneuvering mode based on an operation performed on the steering operator by the vessel operator to steer the marine vessel during the movement of the marine vessel in the automatic marine vessel maneuvering mode.

2. The steering control system according to claim 1, wherein the operator further includes an operation lever to manipulate the propulsive force of the propulsion device; and the controller is configured or programmed to cancel the automatic marine vessel maneuvering mode based on an operation performed on the operation lever by the vessel operator to manipulate the propulsive force of the propulsion device during the movement of the marine vessel in the automatic marine vessel maneuvering mode.

3. The steering control system according to claim 2, wherein the operation lever is movable to any of a forward movement position, a neutral position, and a reverse movement position; and the controller is configured or programmed to cancel the automatic marine vessel maneuvering mode based on the operation lever being moved from the forward movement position to either the neutral position or the reverse movement position by the vessel operator during the movement of the marine vessel in the automatic marine vessel maneuvering mode.

4. The steering control system according to claim 3, wherein the operator further includes a plurality of operation levers; and the controller is configured or programmed to cancel the automatic marine vessel maneuvering mode based on all of the plurality of operation levers being moved to neutral positions during the movement of the marine vessel in the automatic marine vessel maneuvering mode.

5. The steering control system according to claim 3, wherein the operator further includes a plurality of operation levers; and the controller is configured or programmed to cancel the automatic marine vessel maneuvering mode based on at least one of the plurality of operation levers being moved to the reverse movement position during the movement of the marine vessel in the automatic marine vessel maneuvering mode.

6. The steering control system according to claim 2, wherein the steering operator includes a steering wheel; and the controller is configured or programmed to cancel the automatic marine vessel maneuvering mode based on the steering wheel being rotated by the vessel operator during the movement of the marine vessel in the automatic marine vessel maneuvering mode.

7. The steering control system according to claim 1, wherein the operator further includes an automatic marine vessel maneuvering mode operator to start the automatic marine vessel maneuvering mode; and the controller is configured or programmed to cancel the automatic marine vessel maneuvering mode based on an operation performed on the automatic marine vessel maneuvering mode operator by the vessel operator during the movement of the marine vessel in the automatic marine vessel maneuvering mode.

8. The steering control system according to claim 1, wherein the operator further includes a power switch to turn on/off power supply from a power source to the propulsion device; and the controller is configured or programmed to cancel the automatic marine vessel maneuvering mode based on an operation performed on the power switch by the vessel operator during the movement of the marine vessel in the automatic marine vessel maneuvering mode.

9. The steering control system according to claim 1, further comprising:

an orientation sensor to detect an orientation of a hull; and a position sensor to detect a position of the hull; wherein the controller is configured or programmed to detect an abnormality in at least one of the orientation sensor or the position sensor, and cancel the automatic marine vessel maneuvering mode based on the abnormality detected in at least one of the orientation sensor or the position sensor during the movement of the marine vessel in the automatic marine vessel maneuvering mode.

10. The steering control system according to claim 1, wherein the operator further includes an automatic marine vessel maneuvering mode operator to start the automatic marine vessel maneuvering mode and an operation lever to manipulate the propulsive force of the propulsion device;

the operation lever is movable to any of a forward movement position, a neutral position, and a reverse movement position;

the controller is configured or programmed to cancel the automatic marine vessel maneuvering mode based on the operation lever being moved from the forward movement position to either the neutral position or the reverse movement position by the vessel operator during the movement of the marine vessel in the automatic marine vessel maneuvering mode, and to start a manual marine vessel maneuvering mode to change the propulsive force of the propulsion device by a manual operation on the operation lever; and the controller is configured or programmed to cancel the manual marine vessel maneuvering mode based on the operation lever being moved from either the neutral position or the reverse movement position to the forward movement position by the vessel operator during movement of the marine vessel in the manual marine vessel maneuvering mode and the automatic marine vessel maneuvering mode operator being operated by the vessel operator during the movement of the marine vessel in the manual marine vessel maneuvering mode, and to restart the automatic marine vessel maneuvering mode.

11. The steering control system according to claim 1, wherein the controller is configured or programmed to perform any of a control to move a hull while maintaining an orientation of the hull, a control to move the hull while maintaining a course of the hull, a control to move the hull such that the hull passes through a target passing point, and a control to move the hull along a predetermined course pattern in the automatic marine vessel maneuvering mode.

12. A marine vessel comprising:

a hull;

a propulsion device attached to the hull;

a controller configured or programmed to perform at least one of a control to automatically steer the hull or a control to automatically change a propulsive force of the propulsion device in an automatic marine vessel maneuvering mode during movement of the marine vessel; and an operator to perform at least one predetermined operation of operating the propulsion device, starting the automatic marine vessel maneuvering mode by the controller, turning on/off power supply to the propulsion device, or steering the marine vessel; wherein the controller is configured or programmed to cancel the automatic marine vessel maneuvering mode based on an operation performed on the operator by a vessel operator to perform the predetermined operation during the movement of the marine vessel in the automatic marine vessel maneuvering mode;

the operator includes a steering operator to steer the marine vessel; and the controller is configured or programmed to cancel the automatic marine vessel maneuvering mode based on an operation performed on the steering operator by the vessel operator to steer the marine vessel during the movement of the marine vessel in the automatic marine vessel maneuvering mode.

13. The marine vessel according to claim 12, wherein the operator further includes an operation lever to manipulate the propulsive force of the propulsion device; and the controller is configured or programmed to cancel the automatic marine vessel maneuvering mode based on an operation performed on the operation lever by the vessel operator to manipulate the propulsive force of the propulsion device during the movement of the marine vessel in the automatic marine vessel maneuvering mode.

14. The marine vessel according to claim 13, wherein the operation lever is movable to any of a forward movement position, a neutral position, and a reverse movement position; and the controller is configured or programmed to cancel the automatic marine vessel maneuvering mode based on the operation lever being moved from the forward movement position to either the neutral position or the reverse movement position by the vessel operator during the movement of the marine vessel in the automatic marine vessel maneuvering mode.

15. A steering control method of a marine vessel, the method comprising:

performing at least one of a control to automatically steer the marine vessel or a control to automatically change a propulsive force of a propulsion device in an automatic marine vessel maneuvering mode during movement of the marine vessel; and canceling the automatic marine vessel maneuvering mode based on an operation performed on an operator by a vessel operator to perform at least one predetermined operation of operating the propulsion device, starting the automatic marine vessel maneuvering mode, turning on/off power supply to the propulsion device, or steering the marine vessel during the movement of the marine vessel in the automatic marine vessel maneuvering mode; wherein the operator includes a steering operator to steer the marine vessel.

16. The steering control method according to claim 15, wherein the operator further includes an operation lever to manipulate the propulsive force of the propulsion device; and the canceling of the automatic marine vessel maneuvering mode includes canceling the automatic marine vessel maneuvering mode based on an operation performed on the operation lever by the vessel operator to manipulate the propulsive force of the propulsion device during the movement of the marine vessel in the automatic marine vessel maneuvering mode.

17. The steering control method according to claim 16, wherein the canceling of the automatic marine vessel maneuvering mode includes canceling the automatic marine vessel maneuvering mode based on the operation lever being moved from a forward movement position to a neutral position or a reverse movement position by the vessel operator during the movement of the marine vessel in the automatic marine vessel maneuvering mode.

18. The steering control method according to claim 17, wherein the operator further includes a plurality of operation levers; and the canceling of the automatic marine vessel maneuvering mode includes canceling the automatic marine vessel maneuvering mode based on all of the plurality of operation levers being moved to neutral positions during the movement of the marine vessel in the automatic marine vessel maneuvering mode.

19. The steering control method according to claim 15, wherein the steering operator includes a steering wheel; and the canceling of the automatic marine vessel maneuvering mode includes canceling the automatic marine vessel maneuvering mode based on the steering wheel being rotated by the vessel operator during the movement of the marine vessel in the automatic marine vessel maneuvering mode.

20. The steering control method according to claim 16, further comprising:

detecting an abnormality in at least one of an orientation sensor that detects an orientation of a hull or a position sensor that detects a position of the hull; wherein the canceling of the automatic marine vessel maneuvering mode includes canceling the automatic marine vessel maneuvering mode based on the abnormality detected in at least one of the orientation sensor or the position sensor during the movement of the marine vessel in the automatic marine vessel maneuvering mode.

* * * * *